US012570491B2

(12) United States Patent
Kim et al.

(10) Patent No.: US 12,570,491 B2
(45) Date of Patent: Mar. 10, 2026

(54) ROLLER FOR SUPPORTING MATERIALS

(71) Applicant: LG Energy Solution, Ltd., Seoul (KR)

(72) Inventors: Kisu Kim, Daejeon (KR); Seyong Na, Daejeon (KR); Sungmin Park, Daejeon (KR); Jin Soo Lee, Daejeon (KR); Jung Su Oh, Daejeon (KR); Seongwon Yoon, Daejeon (KR)

(73) Assignee: LG Energy Solution, Ltd., Seoul (KR)

( * ) Notice: Subject to any disclaimer, the term of this patent is extended or adjusted under 35 U.S.C. 154(b) by 138 days.

(21) Appl. No.: 18/291,297

(22) PCT Filed: Oct. 13, 2022

(86) PCT No.: PCT/KR2022/015444

§ 371 (c)(1),
(2) Date: Jan. 23, 2024

(87) PCT Pub. No.: WO2023/080469

PCT Pub. Date: May 11, 2023

(65) Prior Publication Data

US 2024/0343518 A1 Oct. 17, 2024

(30) Foreign Application Priority Data

Nov. 3, 2021 (KR) ..... 10-2021-0149599

(51) Int. Cl.
*B65H 75/24* (2006.01)
*B65H 27/00* (2006.01)
*B65H 75/18* (2006.01)

(52) U.S. Cl.
CPC ..... *B65H 27/00* (2013.01); *B65H 75/24* (2013.01); *B65H 75/18* (2013.01); *B65H 75/246* (2013.01);
(Continued)

(58) Field of Classification Search
CPC .. B65H 75/246; B65H 75/249; B65H 75/185; B65H 75/248; B65H 75/2484; B65H 75/2487; B65H 16/06
(Continued)

(56) References Cited

U.S. PATENT DOCUMENTS 180,169 A * 7/1876 Tasker ..... B23B 31/40 279/2.13
1,072,067 A * 9/1913 Wild ..... B65H 75/246 242/571.7
(Continued)

FOREIGN PATENT DOCUMENTS

CH 612478 A5 * 7/1979
CN 108946038 A 12/2018
(Continued)

OTHER PUBLICATIONS

Extended European Search Report including Written Opinion for Application No. 22890204.5, dated Dec. 10, 2024, 8 pgs.
(Continued)

*Primary Examiner* — Anna M Momper
*Assistant Examiner* — Ermia E. Melika
(74) *Attorney, Agent, or Firm* — Lerner David LLP

(57) ABSTRACT

A roller for supporting a material according to an embodiment of the present invention includes: a rotation shaft; a pipe having a space in which the rotation shaft is inserted; a deforming part that is connected to the rotation shaft and the pipe to deform the pipe; and a support part that is installed at the pipe to support the material. The deforming part includes: a thread portion provided on the rotation shaft; a nut part screwed to the thread portion; an inclined part that is disposed at an inner surface of the pipe and that is pressed
(Continued)

by the nut part according to rotation of the rotation shaft; and a driving source that is connected to the rotation shaft to rotate the rotation shaft.

9 Claims, 4 Drawing Sheets

(52) U.S. Cl.
CPC ..... *B65H 75/248* (2013.01); *B65H 75/2484* (2021.05); *B65H 75/2487* (2021.05); *B65H 75/249* (2021.05); *B65H 2404/1321* (2013.01); *B65H 2601/2532* (2013.01); *B65H 2701/19* (2013.01)

(58) Field of Classification Search
USPC ..... 242/571, 571.6, 571.7, 573.1, 573.5, 242/573.3, 575, 575.2, 575.3
See application file for complete search history.

(56) References Cited

U.S. PATENT DOCUMENTS

| | | | | | |
|---|---|---|---|---|---|
| 2,161,061 | A * | 6/1939 | Keyes | B65H 75/246 | 74/568 R |
| 2,635,330 | A * | 4/1953 | David | B23K 11/0876 | 219/67 |
| 3,392,431 | A | 7/1968 | Bisang | | |
| 3,637,156 | A * | 1/1972 | Shepherd | B65H 54/543 | 242/573.7 |
| 3,672,018 | A * | 6/1972 | Junk | F16C 13/024 | 492/7 |
| 3,745,625 | A * | 7/1973 | Jaegers | D21F 1/40 | 493/406 |
| 3,899,141 | A * | 8/1975 | Padgett, Jr. | B65H 54/543 | 242/571.6 |
| 4,253,392 | A | 3/1981 | Brandon et al. | | |
| 4,487,122 | A * | 12/1984 | George | B41F 13/18 | 100/162 B |
| 4,692,971 | A * | 9/1987 | Ginter | D06C 3/06 | 26/103 |
| 5,522,785 | A | 6/1996 | Kedl et al. | | |
| 6,110,093 | A | 8/2000 | Slusarz | | |
| 6,524,227 | B1 | 2/2003 | Isometsa et al. | | |
| 6,543,713 | B1 * | 4/2003 | Frolander | B65H 75/4402 | 242/397.2 |
| 7,914,430 | B2 * | 3/2011 | Pajala | F16C 13/00 | 492/53 |
| 8,029,201 | B2 * | 10/2011 | Chen | B41J 33/14 | 242/573.7 |
| 9,409,179 | B2 * | 8/2016 | Ueda | B02C 4/44 | |
| 9,440,796 | B2 | 9/2016 | Axmann | | |
| 2001/0002381 | A1 | 5/2001 | Karvonen et al. | | |
| 2005/0211821 | A1 | 9/2005 | Hein et al. | | |
| 2007/0246168 | A1 * | 10/2007 | Ito | E04F 10/0618 | 160/22 |
| 2015/0210497 | A1 | 7/2015 | Zhou | | |

FOREIGN PATENT DOCUMENTS

| | | | | |
|---|---|---|---|---|
| CN | 110182631 B | * | 10/2020 | B65H 16/06 |
| CN | 111003550 B | * | 5/2021 | B65H 18/10 |
| CN | 113270630 B | * | 11/2021 | H01M 10/0587 |
| JP | S56118952 A | | 9/1981 | |
| JP | 57137249 A | * | 8/1982 | |
| JP | 58063643 A | * | 4/1983 | |
| JP | 2015217528 A | | 12/2015 | |
| JP | 2017191678 A | | 10/2017 | |
| KR | 20030058310 A | | 7/2003 | |
| KR | 100653135 B1 | | 12/2006 | |
| KR | 101952266 B1 | | 2/2019 | |

OTHER PUBLICATIONS

International Search Report for Application No. PCT/KR2022/015444 mailed Jan. 20, 2023. 3 pages.

* cited by examiner

ROLLER FOR SUPPORTING MATERIALS

CROSS-REFERENCE TO RELATED APPLICATION(S)

The present application is a national phase entry under 35 U.S.C § 371 of International Application No. PCT/KR2022/015444 filed on Oct. 13, 2022 which claims the benefit of priority based on Korean Patent Application No. 10-2021-0149599 filed on Nov. 3, 2021, all contents of which are incorporated herein by reference.

TECHNICAL FIELD

An aspect of the present invention relates to a roller for supporting a material, and more specifically, to a roller for supporting a material of a thin film.

BACKGROUND ART

As technology development and demand for mobile devices increase, demand for a secondary battery as an energy source is rapidly increasing. In particular, the secondary battery is attracting much attention as an energy source not only for a mobile device such as a mobile phone, a digital camera, a laptop computer, a wearable device, or the like, but also for a power device such as an electric bicycle, an electric vehicle, a hybrid electric vehicle, or the like.

The secondary battery may be formed by inserting an electrode assembly including a positive electrode, a negative electrode, and a separator in a case and then sealing the case. For example, the positive electrode, the negative electrode, and the separator are manufactured through a roll-to-roll manufacturing process using their own thin materials.

The thin film material is usually formed as a sheet during the manufacturing process, the sheet is supported by a roller, and the roller needs to support the thin film material so that deformation such as a wrinkle does not occur in the thin film material during the manufacturing process.

This may also be applied to other materials (e.g., a film or a PET film) that are manufactured into products desired by a consumer using a roll-to-roll method.

DISCLOSURE

Technical Problem

An object to be solved by an aspect of the present invention is to provide a roller for supporting a material capable of preventing an error phenomenon such as a wrinkle in the material while supporting the material during a manufacturing process.

A problem to be solved by an aspect of the present invention is not limited to the above-described problem, and problems not mentioned will be clearly understood by a person of ordinary skill in the art from the present specification and the accompanying drawings.

Technical Solution

A roller for supporting a material according to an embodiment of the present invention includes: a rotation shaft; a pipe having a space in which the rotation shaft is inserted; a deforming part that is connected to the rotation shaft and the pipe to deform the pipe; and a support part that is installed at the pipe to support the material. The deforming part includes: a thread portion provided on the rotation shaft; a nut part screwed to the thread portion; an inclined part that is disposed at an inner surface of the pipe and that is pressed by the nut part according to rotation of the rotation shaft; and a driving source that is connected to the rotation shaft to rotate the rotation shaft.

The thread portion may include a left thread portion and a right thread portion, the nut part may be provided as a pair disposed at an arbitrary interval at the left thread portion and the right thread portion, and the inclined part may be provided as a pair to correspond to the pair of nut parts, respectively.

The pair of nut parts may be connected to a guide shaft disposed parallel to the rotation shaft.

The pair of inclined parts may have a shape that becomes inclined from a periphery portion of the pipe to a center portion of the pipe.

In addition, the pair of inclined parts may have a shape that thickens from the periphery portion of the pipe as it extends to the center portion of the pipe.

The pair of nut parts may move from the periphery portion of the pipe to the center portion of the pipe according to the rotation of the rotation shaft to press the inclined part.

The pipe may be convexly deformed by pressurization of the inclined part in a direction in which the inclined part is positioned.

The support part may include a bobbin coupled to a bearing installed at the pipe, and the bobbin may be installed in a plurality at the pipe.

The material may be an electrode or a separator of a secondary battery.

Advantageous Effects

According to embodiments, a roller can be varied and a degree of variation is also adjustable.

Accordingly, the roller according to an embodiment may flexibly support a material according to a characteristic of the material to be supported, and the material may be manufactured as a quality product while preventing an abnormality such as a wrinkle during a manufacturing process.

An effect of an aspect of the present invention is not limited to the above-described effects, and effects not mentioned will be clearly understood by a person of ordinary skill in the art from the present specification and the accompanying drawings.

DETAILED DESCRIPTION

Figure 1:
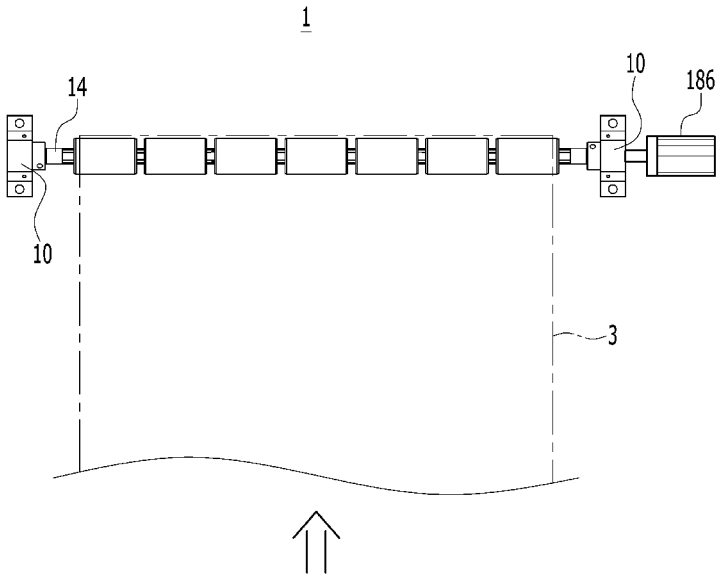
FIG. 1 is a plan view illustrating a roller according to an embodiment of the present invention.

Embodiments of the present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Parts that are irrelevant to the description are omitted in the drawings for a clearer description of embodiments of the present invention, and like reference numerals designate like elements throughout the specification.

Further, the size and thickness of the elements shown in the drawings are arbitrarily illustrated for better understanding and ease of description, and embodiments of the present invention are not necessarily limited thereto. In the drawings, the thickness of layers, films, panels, regions, etc., are exaggerated for clarity. In the drawings, for convenience of description, the thickness of layers, films, panels, areas, etc., are exaggerated.

Unless explicitly described to the contrary, the word "comprise" and variations such as "comprises" or "comprising" will be understood to imply the inclusion of stated elements but not the exclusion of any other elements.

The phrase "in a plan view" or "on a plane" means viewing a target portion from the top, and the phrase "in a cross-sectional view" or "on a cross-section" means viewing a cross-section formed by vertically cutting a target portion from the side.

FIG. 1 is a plan view illustrating a roller 1 for supporting a material according to an embodiment of the present invention. The roller 1 is disposed at one side of the material 3 (for example, below the material 3) conveyed (transferred) along one direction (e.g., a direction of an arrow in FIG. 1) to support the material 3.

The roller 1 according to the embodiment is varied based on the material 3 so that it is configured to better support the material 3. For example, the roller 1 is configured to adjust a degree of variation according to a characteristic of the material 3. For example, the material 3 may be an electrode or a separator for an electrode assembly of a secondary battery, but the material of embodiments of the present invention is not limited thereto.

Figure 2:
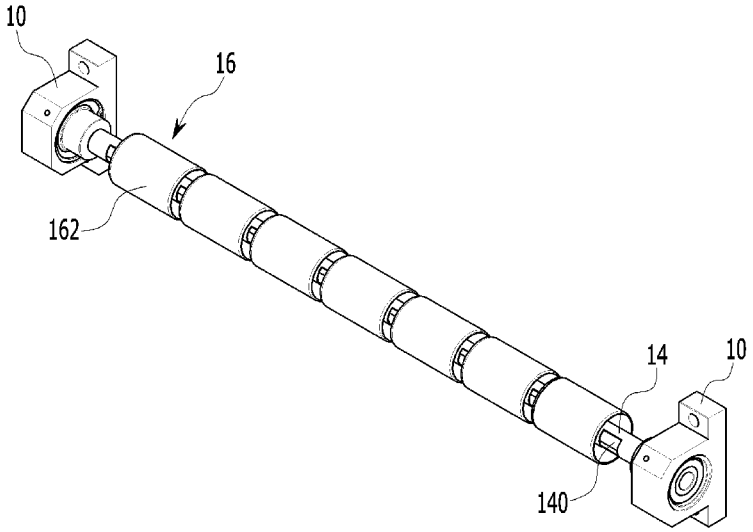
FIG. 2 is a perspective view illustrating the roller according to an embodiment of the present invention.
Figure 3:
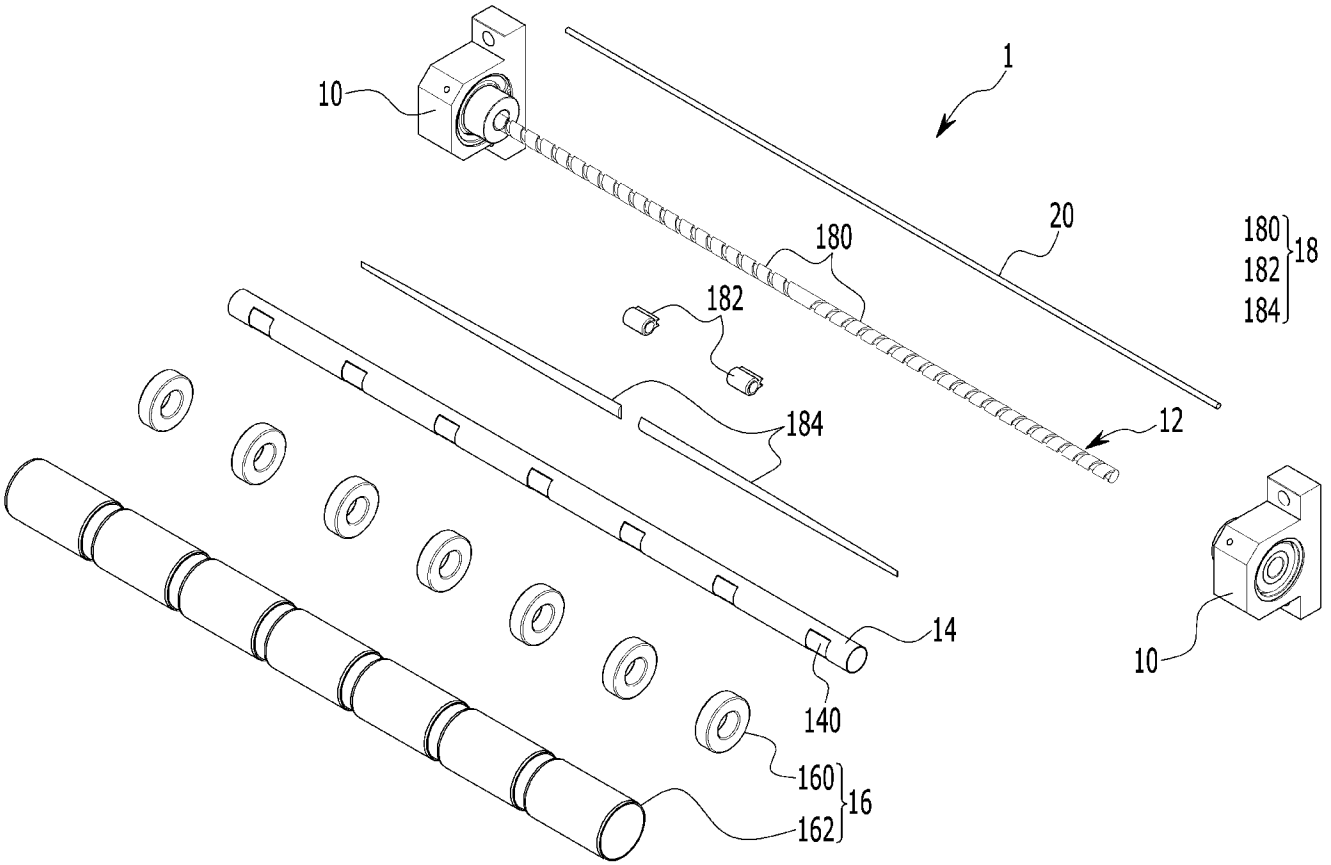
FIG. 3 is an exploded perspective view illustrating the roller of FIG. 2.

FIG. 2 is a perspective view illustrating the roller 1 according to an embodiment of the present invention, and FIG. 3 is an exploded perspective view of the roller 1.

As shown in FIGS. 2 and 3, the roller 1 includes a rotation shaft 12 that is rotatably installed in both holders 10 and a cylindrical pipe 14 disposed at the outside of the rotation shaft 12 while surrounding the rotation shaft.

The pipe 14 may have a space for inserting the rotation shaft 12 and both ends of the pipe 14 may be fixed to the holders 10. In a state where the rotation shaft 12 is inserted in an inner space of the pipe 14, a predetermined interval is set between an inner circumferential surface of the pipe 14 and an outer circumferential surface of the rotation shaft 12, and incisions 140 of a predetermined size may be disposed at equal intervals along a length direction of the pipe 14.

In addition, the roller 1 according to the embodiment includes a support part 16 installed at the pipe 14 to support the material 3 and a deforming part 18 connected to the rotation shaft 12 and the pipe 14 to deform the pipe 14.

In the present embodiment, the support part 16 includes a bobbin 162 that is coupled to a bearing 160 installed at the pipe 14 so that it can be rotated. A plurality of bobbins 162 (for example, seven bobbins) may be installed at the pipe 14.

The deforming part 18 includes a thread portion 180 provided on the rotation shaft 12 and a nut part 182 that is screwed to the thread portion 180 so that it can be moved along a length direction of the rotation shaft 12 according to rotation of the rotation shaft 12.

In the present embodiment, the thread portion 180 includes left and right thread portions, and the nut part 182 includes a pair of nut parts respectively screwed to the left thread portion and the right thread portion. The pair of nut parts 182 may move toward a center portion of the rotation shaft 12 when the rotation shaft 12 rotates in one direction, and the pair of nut parts 182 may move toward a periphery portion of the rotation shaft 12 when the rotation shaft rotates in a direction opposite to the one direction.

Figure 4:
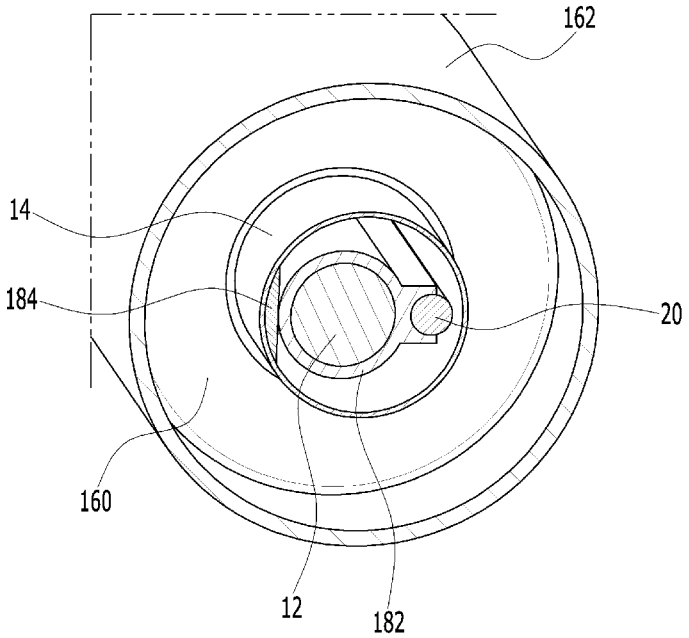
FIG. 4 is a partially cut-away perspective view of the roller of FIG. 2.

Referring to FIG. 4, the nut parts 182 may be connected to a guide shaft 20 having both ends respectively fixed to the holder 10 so that the nut parts performs the above movement while being guided by the guide shaft 20.

In addition, the deforming part 18 includes an inclined part 184 disposed at an inner surface of the pipe 14 and a driving source 186 (e.g., a driving motor of FIG. 1) connected to the rotation shaft 12 to drive the rotation shaft 12.

In the present embodiment, the inclined part 184 may be provided as a pair to correspond to the nut portion 182, and the pair of inclined parts may be fixedly installed at an inner surface of the pipe 14 at an arbitrary interval. One surface (e.g., a surface facing the nut part) of the inclined part 184 may be flat, while the other surface (e.g., a surface facing the inner surface of the pipe) facing the one surface may be curved according to an inner curvature of the pipe 14.

The inclined part 184 may have a shape in which its thickness and width decrease from one end to the other end. When the inclined part 184 is disposed on the inner surface of the pipe 14, for example, a thickness of the inclined part 184 becomes thicker moving from a periphery portion of the pipe 14 to a center portion of the pipe 14. Thus, the inclined part 184 becomes inclined from the periphery portion of the pipe 14 to the center portion of the pipe 14.

Figure 5A:
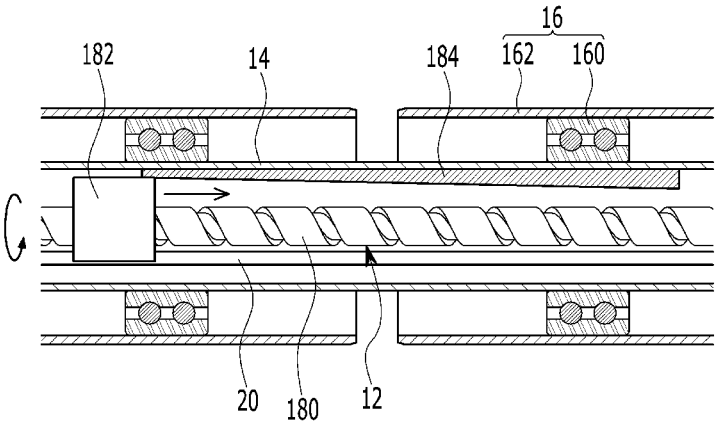
FIGS. 5A and 5B are views illustrating an operation state of the roller according to an embodiment of the present invention.

Accordingly, when the rotation shaft 12 is rotated by the driving motor that is the driving source 186 in a state shown in FIG. 5A, the pair of nut parts 182 may respectively move to the center portion of the rotation shaft 12 due to a screw coupling relationship with the left and right thread portions 180 to contact the inclined part 184 so that the pair of nut parts 182 press the inclined part 184.

Figure 5B:
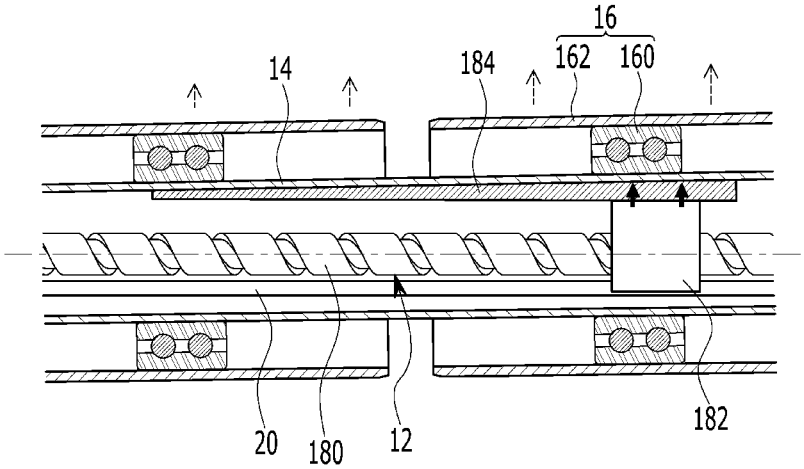

When the inclined part 184 is pressed, the inclined part 184 is pushed into the side of the pipe 14 so that the pipe 14 is deformed. As a result, the pipe 14 is convexly deformed in a direction in which the inclined part 184 is disposed. By this deformation, the bobbin 162, which is the support part 16, may also be deformed from its initial position so that the bobbin gives more tension to the material 3 supported by the bobbin. For example, as shown in FIG. 5B, as the nut part 182 moves toward a center (a right side of FIG. 5B), the pipe 14 may be deformed to become convex to one side (an upper side of FIG. 5B). Accordingly, a degree of tension may increase as the nut part 182 moves closer to the center portion of the pipe 14.

Thus, the roller 1 according to the present embodiment may adjust the degree of tension applied to the material 3 by the support part 16 by deforming the pipe 14 using the deforming part 18 as necessary during a manufacturing process.

Therefore, in a process in which the roller 1 according to the present embodiment is applied, the material 3 may be supported by adjusting a tension to match a characteristic of the material 3 according to a property of the material 3. Thus, a defect phenomenon such as a wrinkle may be prevented so that the material 3 is manufactured as a product of good quality.

While embodiments of the invention have been described in connection with what is presently considered to be practical embodiments, it is to be understood that the invention is not limited to the disclosed embodiments. On the contrary, it is intended to cover various modifications and equivalent arrangements included within the spirit and scope of the appended claims.

DESCRIPTION OF SYMBOLS

1: roller
3: material
10: holder
12: rotation shaft
14: pipe
16: support part
18: deforming part
20: guide shaft
140: incisions
160: bearing
162: bobbin
180: thread portion
182: nut part
184: inclined part
186: driving source

The invention claimed is:

1. A roller for supporting a material, comprising:
a rotation shaft;
a pipe configured to receive the rotation shaft therein;
a deforming part coupled to the rotation shaft and the pipe, wherein the deforming part is configured to deform the pipe; and
a support part coupled to the pipe, wherein the support part is configured to support the material,
wherein the deforming part comprises:
a thread portion positioned on the rotation shaft;
a pair of nut parts engaged with the thread portion;
an inclined part disposed in contact with an inner circumferential surface of the pipe, wherein the inclined part is configured to be pressed by the nut part according to a rotation of the rotation shaft; and
a driving source coupled to the rotation shaft, wherein the driving source is configured to rotate the rotation shaft,
wherein each of the pair of nut parts are coupled to a guide shaft disposed parallel to the rotation shaft.

2. The roller of claim 1, wherein the thread portion includes a left thread portion and a right thread portion, the pair of nut parts are disposed at predetermined interval on each of the left thread portion and the right thread portion, and the inclined part is provided as a pair of inclined parts, wherein each of the pair of inclined parts is disposed to contact each of the pair of nut parts, respectively.

3. The roller of claim 2, wherein each of the pair of inclined parts is disposed at an incline in a longitudinal direction extending from a periphery portion of the pipe to a center portion of the pipe.

4. The roller of claim 3, wherein each of the pair of inclined parts thickens in the longitudinal direction extending from the periphery portion of the pipe to the center portion of the pipe.

5. The roller of claim 4, wherein each of the pair of nut parts is configured to move from the periphery portion of the pipe to the center portion of the pipe according to the rotation of the rotation shaft, so as to press each of the pair of inclined parts.

6. The roller of claim 5, wherein the pipe is configured to be convexly deformed by each of the pair of inclined parts.

7. The roller of claim 1, wherein the support part includes a bobbin coupled to a bearing disposed in contact with the pipe.

8. The roller of claim 7, wherein a plurality of bobbins are disposed on the pipe.

9. The roller of claim 1, wherein the material is an electrode or a separator of a secondary battery.

* * * * *